United States Patent [19]

Maldonado

[11] 4,191,112

[45] Mar. 4, 1980

[54] INTERNESTABLE STORAGE RACK

[75] Inventor: Felipe Maldonado, Miami, Fla.

[73] Assignee: Equipment Company of America, Hialeah, Fla.

[21] Appl. No.: 2,420

[22] Filed: Jan. 10, 1979

[51] Int. Cl.[2] ..... B65D 19/38

[52] U.S. Cl. ..... 108/53.3; 108/53.5; 211/194

[58] Field of Search ..... 108/53.1–53.5, 108/55.1, 55.5, 51.1, 56.1, 91; 211/194; 206/386, 600, 599, 507, 505, 503

[56] References Cited

U.S. PATENT DOCUMENTS

| | | | |
|---|---|---|---|
| 3,709,163 | 1/1973 | Smedley et al. | 108/53.5 |
| 3,762,343 | 10/1973 | Thacker | 108/53.3 |
| 3,945,501 | 3/1976 | Jay | 108/53.5 X |

FOREIGN PATENT DOCUMENTS

| | | | |
|---|---|---|---|
| 334567 | 1/1959 | Switzerland | 108/91 |

*Primary Examiner*—William E. Lyddane

*Attorney, Agent, or Firm*—Cullen, Sloman, Cantor, Grauer, Scott & Rutherford

[57] ABSTRACT

The rigid internestable storage rack accommodates the storage of goods, is adapted for transport by a fork lift truck and consists of a series of four vertically extending support posts, with two posts being located at the front of the rack and with two posts being located at the rear of the rack. The two posts at the rear are closer to one another than the posts at the front of the rack. Front and rear lower brace members are provided between the front posts and the rear posts respectively. A pair of opposed lower cross brace members are also provided, with each having one end abutting one of the rear support posts and being secured thereto. Each lower cross brace member extends toward the front of the rack where it perpendicularly intersects, abuts and is secured to the front lower brace member. An upper rear brace member is supported by the rear support posts and a pair of upper cross brace members extend from the ends of the upper brace member to the front rear posts, with the upper rear brace member and the pair of opposed upper cross brace members being positioned externally of the rear support posts. A socket is located on the top of each of the vertical support posts, with the top surfaces of the sockets lying in a horizontal plane and forming abutments which are adapted to be engaged by lower surface portions of the upper rear rear brace member and the pair of opposed upper cross brace members when internested with other similar racks in a vertically offset stacking posture.

6 Claims, 9 Drawing Figures

INTERNESTABLE STORAGE RACK

BACKGROUND OF THE INVENTION

The prior art illustrates various storage racks which are constructed with various objectives in mind. Generally the provision of storage racks has the end goal of providing a maximum quantum of storage space utilizing a minimum of floor area and, with the foregoing in mind, it has been deemed advisable to construct storage racks which permit the vertical stacking of one rack on top of the other. Such a construction maximizes vertical storage of materials as opposed to spreading the storage of materials horizontally over a warehousing storage or area.

Certain racks are designed to handle different materials. Some storage racks are developed to handle cylindrical loads whereas others are specifically designed for the vertical storage of flat sheet materials. As an example, U.S. Pat. No. 3,844,600 is specifically directed to a storage rack which accommodates large cylindrical loads while at the same time permitting the racks to be transported either by fork lift trucks or by other lifting equipment. Similarly other racks are constructed for convenient storage of larger flat sheet materials such as the rack depicted in U.S. Pat. No. 3,887,078. The storage rack depicted in U.S. Pat. No. 3,887,078 is constructed in a manner to permit the modulization of the component parts of the rack such that a rack of the size sufficient to accommodate only those materials to be stored may be cnstructed on the situs of the warehouse facility. With such a concept, the owner or operator does not require empty storage bins on the floor of the warehouse to take up valuable space when there are no materials to be stored.

A storage rack construction somewhat similar to the present invention is disclosed in U.S. Pat. No. 3,945,501. Such patent in addition to having a plurality of internestable racks further includes with each rack nesting means positioned at the top of each of the vertical support posts. The nesting means may be formed either by a nesting cup, or by tubular members. Each rack further includes mating nestable means which consist of either wedge plates in association with the nesting cups, or tubular rods in association with the tubular members, at least one pair of either the nesting wedge plates, or tubular members, being offset with respect to the opposed cross oriented support posts such that the racks, when stacked, are positioned in vertically offset orientation in order to achieve the internestable stacking thereof.

Other prior art U.S. patents showing stacking racks include the following: Nos. 2,801,752 to R. S. Jakubowski, dated Aug. 6, 1957; 3,195,735 to R. S. Jay, dated July 20, 1965; 3,476,260 to R. S. Jay, dated Nov. 4, 1969; 3,503,519 to R. S. Jay, dated Mar. 31, 1970; 3,565,018 to R. S. Jay, dated Feb. 23, 1971; 3,865,250 to R. S. Jay, dated Feb. 11, 1975; and the prior art cited therein.

SUMMARY OF THE PRESENT INVENTION

The present invention is particularly concerned with the provision of a solid and rigid storage rack for accommodating the storage of goods and materials which is constructed and arranged to permit ease of vertical offset internestable stacking when not in use thus conserving warehouse space and areas.

It is a feature of the present invention to provide a rigid internestable storage rack for accommodating the storage of goods and which is adapted for transport by a fork lift truck or by other lifting equipment.

It is a further feature of the present invention to provide a rigid internestable storage rack having a series of four vertically extending support posts, with two posts being located at the front of the rack and with two posts being located at the rear of the rack and with the two posts at the rear being closer to one another than the two posts at the front of the rack.

A still further feature of the present invention is to provide a rigid internestable storage rack having horizontally extending front and rear lower brace members, with the front lower brace member being located between and abutting the opposing surfaces of the front support posts and being secured thereto with the rear lower brace member being located between and abutting the opposing surfaces of the rear support posts and being secured thereto and with the front lower brace member being longer than the rear lower brace member.

Another feature of the present invention is to provide a rigid internestable storage rack having a pair of horizontally extending and parallel opposed lower cross brace members, with each lower cross brace member having one end abutting one of the rear support posts and being secured thereto, with each lower cross brace member extending towards the front of the rack where it perpendicularly intersects, abuts and is secured to the front lower brace member, and with each of the lower cross brace members being of generally the same length.

Still another feature of the present invention is to provide a rigid internestable storage rack having a rear horizontally extending upper brace member having intermediate portions secured to the rear surfaces of the rear support posts, with the end portions of the rear upper brace member extending laterally outwardly beyond the rear support posts.

A further feature of the present invention is to provide a rigid internestable storage rack having a pair of opposed horizontally extending upper cross brace members which are parallel and of the same length, each upper cross brace member having one end abutting and secured to one of the end portions of the rear upper brace member, with each upper cross brace member extending forwardly towards the front of the rack where it perpendicularly intersects, abuts and is secured to one of the front support posts.

A still further feature of the present invention is to provide a rigid internestable storage rack having the upper rear brace member and the pair of opposed upper cross brace members positioned externally of the rear support posts.

Another feature of the present invention is to provide a rigid internestable storage rack having a socket located on top of each of the vertical support posts, with the top surfaces of the sockets lying in a horizontal plane and forming abutments which are adapted to be engaged by lower surface portions of the upper rear brace member and the pair of opposed cross brace members when internested with other similar racks in a vertically offset stacking posture.

It is another feature of the present invention to provide a rigid internestable storage rack which is simple in construction, economical to manufacture, easy to maintain and is efficient in operation.

DETAILED DESCRIPTION OF A PREFERRED EMBODIMENT

Figure 1:
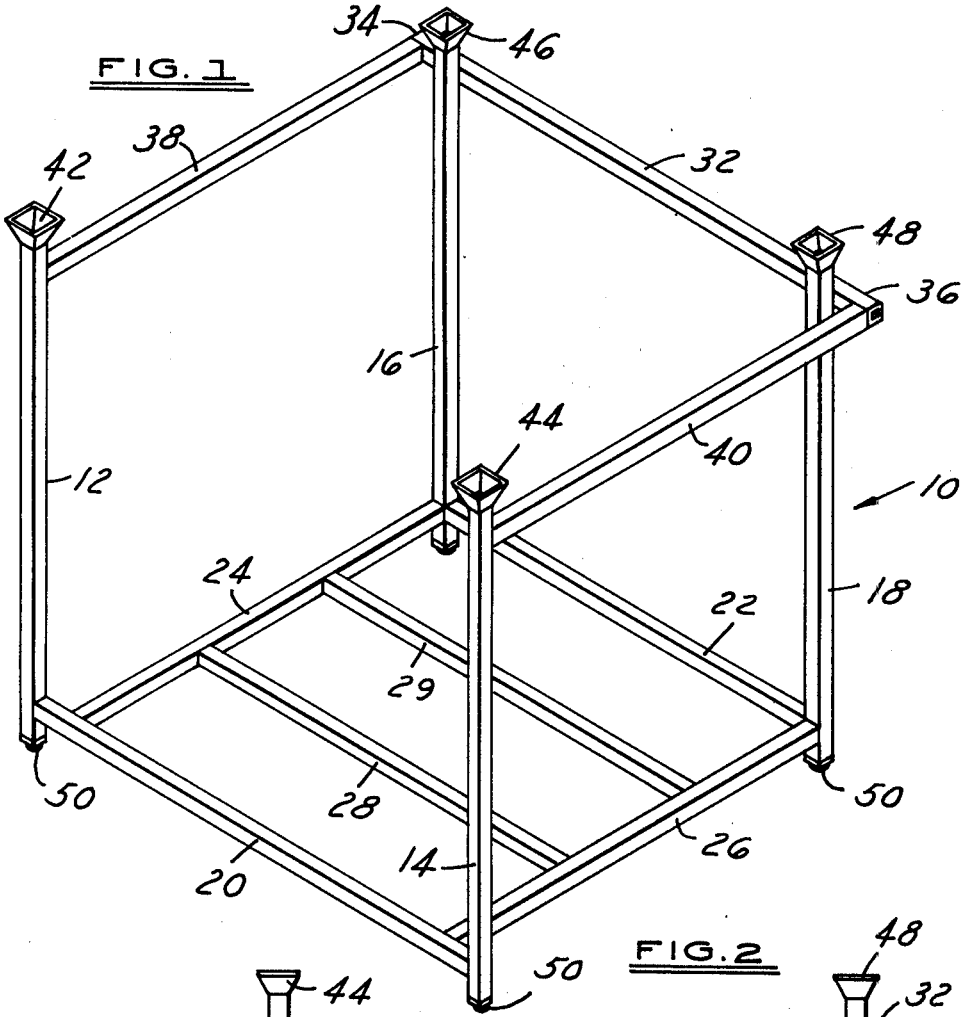
FIG. 1 is a perspective view of a rigid storage rack, with the floor removed.
Figure 2:
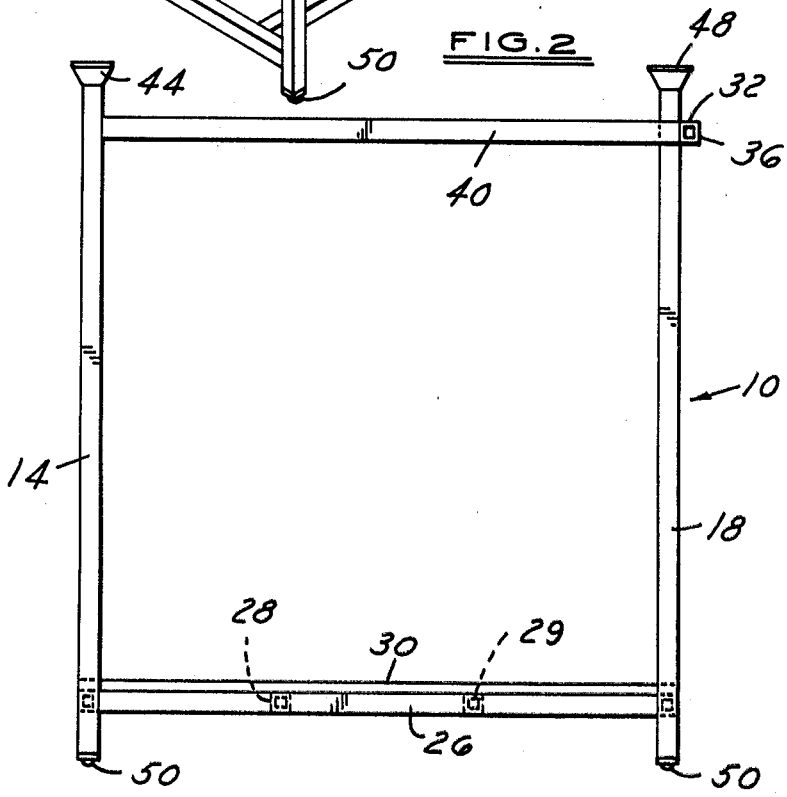
FIG. 2 is a side elevational view of the rigid storage rack.
Figure 3:
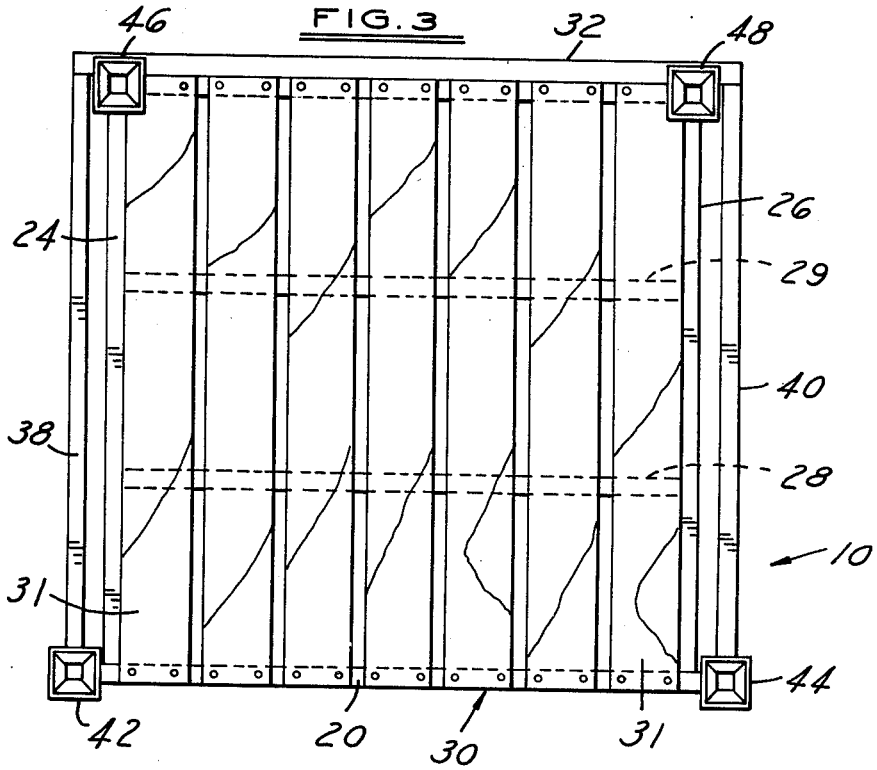
FIG. 3 is a top view of the rigid storage rack.
Figure 9:
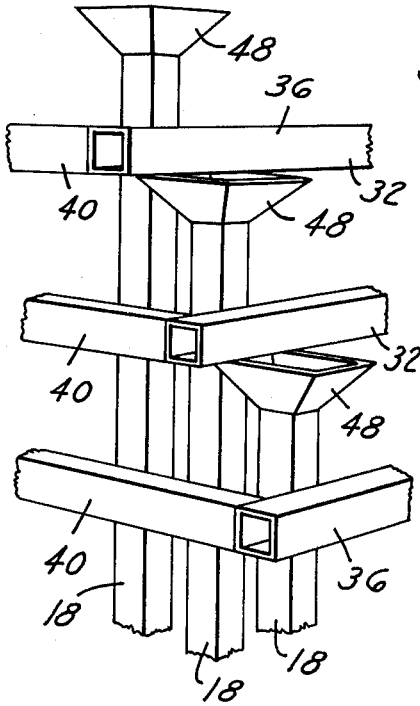
FIG. 9 is a plan view, partly cut away, showing the manner in which the rigid storage racks are internestable one relative to another.
Figure 4:
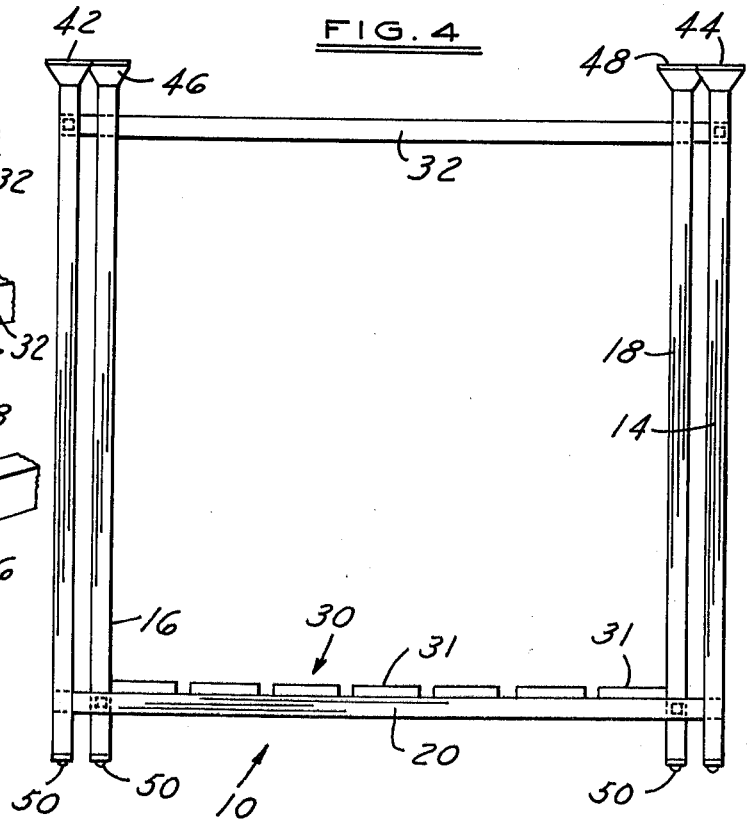
FIG. 4 is a front elevational view of the rigid storage rack.

In the drawings, the rigid internestable storage rack is designated by the numeral 10. It is designed and constructed to accommodate the storage of goods and loads and is adapted for transport by a fork lift truck or by other lifting equipment as is well known in the art. The rack 10 includes a series of four vertically extending support posts of generally tubular construction and of equal height. Two vertical support posts 12 and 14 are located at the front of the rack and two vertical support posts 16 and 18 are located at the rear of the rack 10. The two rear support posts 16, 18 are located closer to one another than are the two posts 12 and 14 located at the front of the rack 10 as is best illustrated in FIG. 1.

The rack 10 further includes a sturdy and rigid lower support structure comprising horizontally extending front and rear lower brace members 20 and 22 respectively. The front lower brace member 20 is located between and abuts the opposing surfaces of the front support posts 12, 14 and is secured thereto by welding or by other suitable means. The rear lower brace member 22 is located between and abuts the opposing surfaces of the rear support posts 16, 18 and are secured thereto by welding or by other suitable means well known in the art. The front lower brace member 20 is longer than the rear lower brace member 22.

The lower support structure of the rack 10 further includes a pair of horizontally extending and parallel opposed lower cross brace members 24, 26. Each lower cross brace member 24, 26 has one end which abuts one of the rear support posts 16, 18 and is secured thereto. Each lower cross brace member 24, 26 extends toward the front of the rack 10 where it perpendicularly intersects, abuts and is secured to the front lower brace member 20 at a distance inwardly set from the front vertical support posts 12, 14 as best illustrated in FIG. 1. Each of the lower cross brace members 24, 26 are of generally the same length.

The lower support structure of the rack 10 further includes a pair of intermediate floor braces 28, 29 which are parallel to the front and rear lower brace members 20, 22. The ends of the floor braces 28, 29 abut and are secured to the lower cross brace members 24, 26 by welding or by other suitable means well known in the art. As an optional feature, a floor 30 may be provided on the lower support structure, with the ends of the floor spanning the front and rear lower brace members 20, 22 and the floor braces 28, 29. The floor 30 may consist of a solid piece of flooring or may consist of a plurality of spaced apart slats 31 which extend perpendicular to the front and rear lower brace members 20, 22 and are secured thereto by appropriate fastening means.

The rack 10 further includes a rear horizontally extending upper brace member 32 which has a length greater than the distance between the two rear corner support posts 16 and 18. The upper rear brace member 32 has intermediate portions abutting and secured to the rear surfaces of the rear support posts 16, 18. The end portions 34, 36 of the rear upper brace member 32 extend laterally outwardly beyond the rear support posts 16, 18 as is best illustrated in FIG. 1.

The rack 10 further includes a pair of opposed horizontally extending upper cross brace members 38, 40 which are parallel to one another and of the same length. Each upper cross brace member 38, 40 has one end abutting and secured to one of the end portions 34, 36 of the rear upper brace member 32. Each upper brace member 38, 40 extends forwardly from the upper cross brace member 32 towards the front of the rack 10 where it perpendicularly intersects, abuts and is secured to one of the front vertical support posts 12, 14. The upper rear brace member 22 and the pair of opposed upper cross brace members 38, 40 are positioned externally of the rear support posts 16, 18 as best illustrated in FIG. 1 to permit internestable stacking of similar racks 10 as will subsequently be described.

Each of the front and rear vertical support posts 12, 14, 16 and 18 is provided with a socket, with the sockets at the front for posts 12 and 14 being designated by the numerals 42 and 44, respectively. The sockets for the rear posts 16 and 18 are designated by the numerals 46 and 48, respectively as best illustrated in FIG. 1. The top surfaces of the sockets lie in a horizontal plane and form abutments which are adapted to be engaged by lower surface portions of the upper rear brace member 32 and by the pair of opposed upper cross brace members 38 and 40 when internested with other similar racks 10 in a vertically offset stacking posture.

In order to add rigidity and stability to the rack 10, the upper and lower members described previously along with the vertical support posts 12, 14, 16 and 18 are made of tubular steel construction, with each having a generally rectangular cross-section. It should be appreciated that any rigid material such as a plastic material may be utilized for the various members and support posts of the rack 10.

Figure 5:
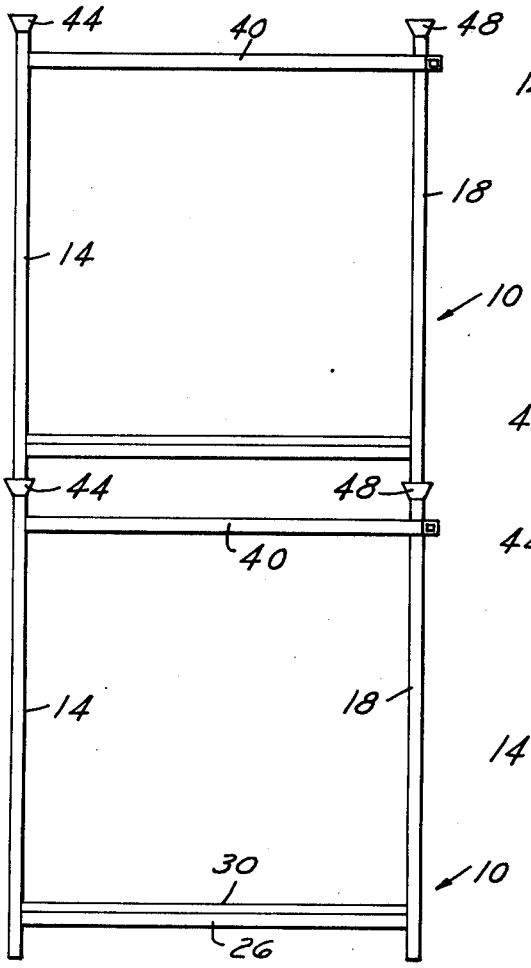
FIG. 5 is a side elevational view of two of the rigid storage racks in vertical stacking orientation.

Each socket 42, 44, 46 and 48 is in the form of a substantially rectangular open cup which is surrounded by side walls and which is welded to the corresponding support post. Each support post 12, 14, 16 and 18 includes a tapered lower end or pintle designated by the numeral 50 which serves the purpose of facilitating the rack stacking mode as shown in FIG. 5. The sockets 42, 44, 46 and 48 serve the dual purpose of providing a cup for the tapered ends or pintles 50 of the vertical support posts 12, 14, 16 and 18 when in the stacking mode as shown in FIG. 5 as well as providing abutments for the brace members 32, 38 and 40 when the racks 10 are stacked together or are positioned in the internesting storage made as shown in FIGS. 6–9 inclusive.

Figure 8:
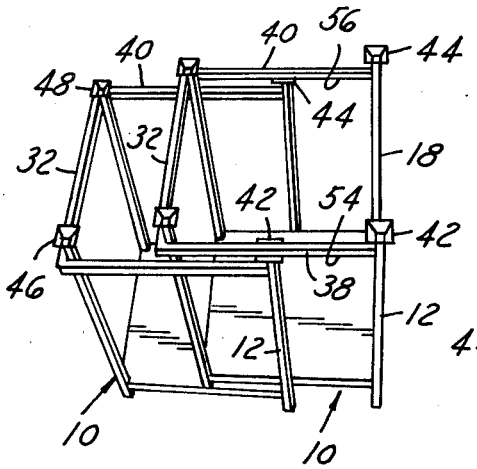
FIG. 8 is a perspective view showing the manner in which a second rigid storage rack fits into and is supported by the first rigid storage rack.
Figure 6:
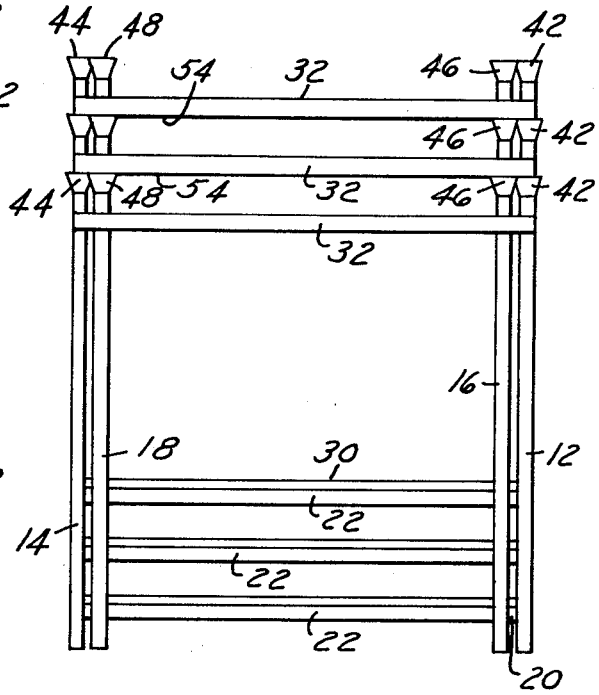
FIG. 6 is a rear elevational view of three of the rigid storage racks in vertically offset internestable stacking relationship for storage purposes.
Figure 7:
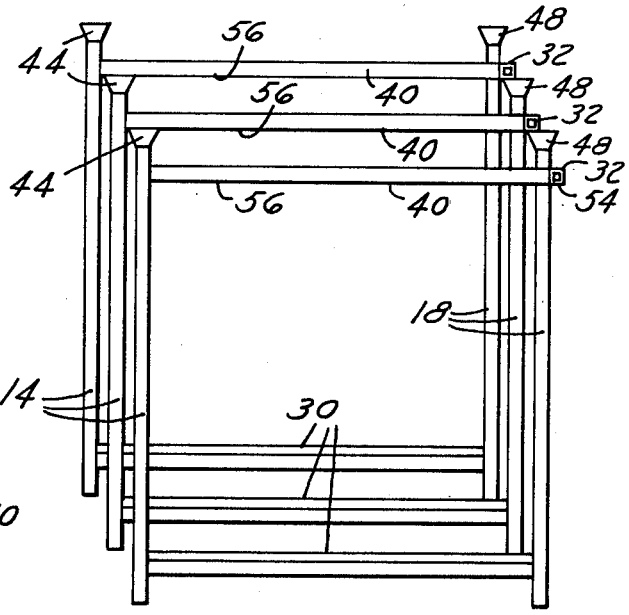
FIG. 7 is a side elevational view of the three internestable storage racks shown in FIG. 6.

When the second rack 10 is inserted through the front of the first rack 10 as shown in FIG. 8, it is supported in a fully nested position as shown in FIGS. 6 and 7, with the bottom horizontal flat surface 52 on the upper rear brace member 32 engaging the top surfaces or abutments of the sockets 46, 48 to support the rear portion of the rack 10 and with the bottom horizontal flat surfaces 54 and 56 provided on the upper cross brace members 38 and 40 respectively engaging and being supported by the top horizontal surfaces or abutments of the sockets 42, 44 to support the front of the rack 10 (FIG. 7).

Due to the design and construction of the various members and in particular the upper rear brace member 32 and the upper cross brace members 38 and 40 which are located outboard or outside of the rear posts 16, 18, the internestable storage arrangement for stacking racks as well as for storing same when not in use results in a vertical offset arrangement as shown in FIG. 7. Thus the system permits convenient and efficient storage of the racks 10 by stacking a plurality of same as described previously while utilizing only a small amount of warehouse area or space when the racks are stored in the manner described.

The rack 10 has sufficient space beneath the lower members to permit the use of any load transport vehicle such as a fork lift truck as is known in the art.

It will be apparent that the construction just described provides a rigid and sturdy storage rack which may accommodate storage of heavy loads while also providing a construction which permits the internestable storage of a plurality of such racks in the minimum amount of warehousing space.

What is claimed is:

1. A rigid internestable storage rack for accommodating the storage of goods and which is adapted for transport by a fork lift truck or the like comprising, a series of four vertically extending support posts, with two posts being located at the front of the rack and with two posts being located at the rear of the rack, with the two posts at the rear being closer to one another than the two posts at the front of the rack, horizontally extending front and rear lower brace members, said front lower brace member being located between and abutting the opposing surfaces of said front support posts and being secured thereto, said rear lower brace member being located between and abutting the opposing surfaces of said rear support posts and being secured thereto, said front lower brace member being longer than said rear lower brace member, a pair of horizontally extending and parallel opposed lower cross brace members, each lower cross brace member having one end abutting one of the rear support posts and being secured thereto, with each such lower cross brace member extending towards the front of the rack where it perpendicularly intersects, abuts and is secured to said front lower brace member, each of said lower cross brace members being of generally the same length, a rear horizontally extending upper brace member having intermediate portions secured to the rear surfaces of aid rear support posts, with the end portions of said rear upper brace member extending laterally outwardly beyond said rear support posts, a pair of opposed horizontally extending upper cross brace members which are parallel and of the same length, each upper cross brace member having one end abutting and secured to one of the end portions of said rear upper brace member, with each upper cross brace member extending forwardly towards the front of the rack where it perpendicularly intersects, abuts and is secured to one of the front support posts, said upper rear brace member and said pair of opposed upper cross brace members being positioned externally of said rear support posts, and a socket located on top of each of said vertical support posts, with the top surfaces of said sockets lying in a horizontal plane and forming abutments which are adapted to be engaged by lower surface portions of said upper rear brace member and said pair of opposed upper cross brace members when internested with other similar racks in a vertically offset stacking posture.

2. The rigid internestable storage rack defined in claim 1 wherein a pair of intermediate floor braces are provided which are parallel to said front and rear lower brace members and have their ends abutting and secured to said lower cross brace members.

3. The rigid internestable storage rack defined in claim 2 wherein said support posts and all of said members are of tubular construction.

4. The rigid internestable storage rack defined in claim 3 wherein said support posts and said members are each of rectangular cross-section.

5. The rigid internestable storage rack defined in claim 2 wherein a floor is provided on said lower brace members, said lower cross brace members and said floor braces.

6. The rigid internestable storage rack defined in claim 5 wherein said floor comprises a plurality of spaced apart slats which extend perpendicular to said front and rear lower brace members.

* * * * *